United States Patent [19]

Nunno

[11] Patent Number: 4,593,933

[45] Date of Patent: Jun. 10, 1986

[54] SKI POLE WRIST STRAP AND SEAT ASSEMBLY

[76] Inventor: Louis E. Nunno, Villa Lots Rd., Paso Robles, Calif. 93446

[21] Appl. No.: 573,052

[22] Filed: Jan. 23, 1984

Related U.S. Application Data

[63] Continuation-in-part of Ser. No. 474,439, Mar. 11, 1983, abandoned.

[51] Int. Cl.[4] ..... A63C 11/00

[52] U.S. Cl. ..... 280/812; 280/820; 280/822

[58] Field of Search ..... 280/812, 819, 820, 821, 280/822; 135/106, 109, 114

[56] References Cited

U.S. PATENT DOCUMENTS

| | | | |
|---|---|---|---|
| 2,445,344 | 7/1948 | Wachtel | 280/812 |
| 3,297,333 | 1/1967 | Schwedt et al. | 280/822 |
| 4,065,140 | 12/1977 | Cadwalader | 280/812 |
| 4,234,202 | 11/1980 | Loffelholz | 280/820 |
| 4,456,284 | 6/1984 | Saka | 280/812 |

*Primary Examiner*—John J. Love
*Assistant Examiner*—Ross Weaver
*Attorney, Agent, or Firm*—Lyon & Lyon

[57] ABSTRACT

A portable ski pole wrist strap and seat assembly comprising a seating strap attached to a retraction device locating within each of two ski poles wherein said retraction device is anchored by a support wire fixed within the ski pole handle. The seating straps having a locking clasp which interlocks with the opposing locking clasp thereby joining the two seating straps allowing the skier to sit on the straps as they are stretched between the two poles. Further, each of said ski poles being equipped with wrist straps connected to breakaway inserts located within the ski pole handle.

12 Claims, 12 Drawing Figures

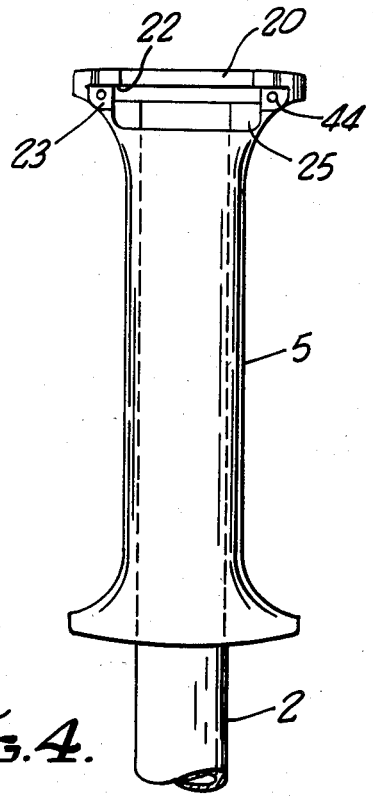
FIG. 4.
FIG. 5.
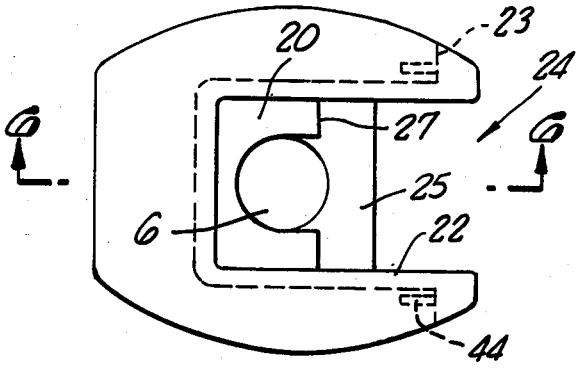
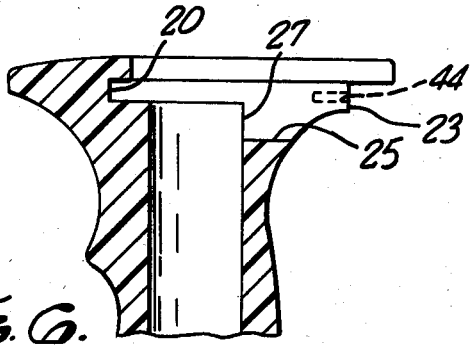
FIG. 6.
FIG. 9.
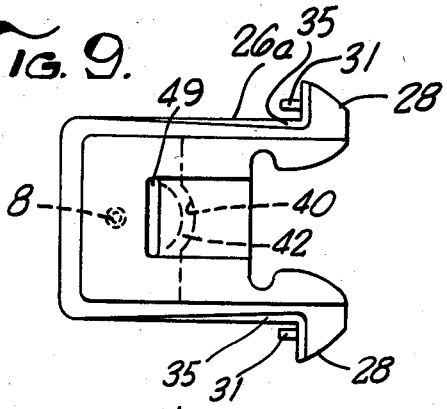
FIG. 7.
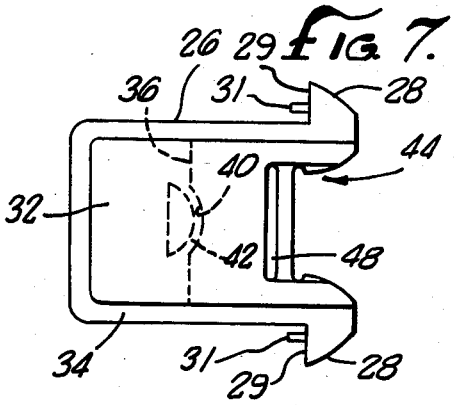
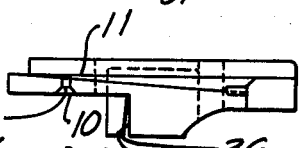
FIG. 10.
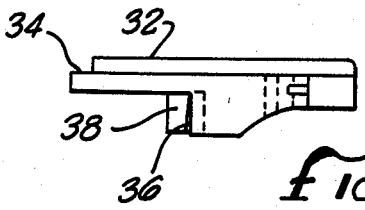
FIG. 8.
FIG. 11.
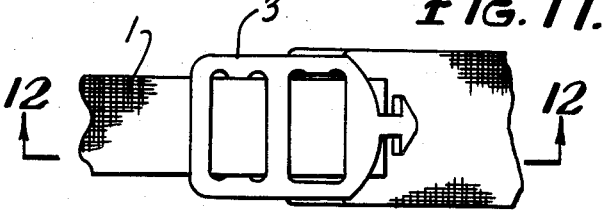
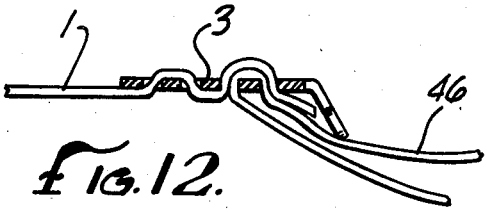
FIG. 12.

SKI POLE WRIST STRAP AND SEAT ASSEMBLY

RELATED APPLICATIONS

This application is a continuation-in-part of U.S. patent application Ser. No. 474,439, filed on Mar. 11, 1983, now abandoned. The specification contained in application Ser. No. 474,439 is hereby incorporated by reference in its entirety.

BACKGROUND OF THE INVENTION

This invention relates to the field of ski pole wrist strap assemblies, in particular to the field of break-away ski pole wrist straps incorporating a seating device to be utilized by snow skiers. At the present time, there is not available a safe break-away wrist strap or portable seating device for use by a snow skier. This invention provides a safe, break-away wrist strap for ski poles which in an alternate embodiment incorporates a portable seating device. Previously, a skier desiring to sit down or take the weight off of his or her feet, either while waiting in a ski lift line or at any other location had to remove his or her skis and sit down in the wet snow or attempt to locate a support such as a rock or fallen tree. This invention provides a portable seating device which is concealed within the standard ski pole used by both alpine and cross-country skiers.

SUMMARY OF THE INVENTION

It is the general purpose and object of this invention to provide a safe, break-away ski pole wrist strap which reduces the chance of injury to the skier's wrist or thumb when the ski pole becomes inadvertently lodged in the snow and also to provide a portable seating device, in conjunction with the wrist strap assembly for the alpine or cross-country skier which does not require the user to carry or transport any additional implements or devices, other than the ski poles he or she is already using. This invention comprises a pair of ski poles, each pole having a retractable seating strap located within the body of the pole. The exterior end of the strap passes through a break-away insert located within the top of the handle of the ski pole and is threaded onto a locking clasp and interlocks with a similar strap located within the second ski pole. The ski poles are then inserted into the snow on either side of the skier who then sits on the joined straps which form a sling between the ski poles. Thus, this invention creates a portable seating device for the skier. When not utilized as a seating device a retraction mechanism within the ski pole retracts the seating strap inside the ski pole.

Furthermore, the invention provides for safe, break-away wrist-straps on the ski pole when the seating strap is retracted inside the ski pole. The exterior ends of the straps are threaded through the locking clasps such that a loop or wrist strap is formed on the exterior of the ski pole when the clasp is retracted atop the break-away insert.

Therefore, it is an object of my invention to provide a safe, break-away wrist strap for ski poles which eliminates or reduces injury when the ski pole becomes stuck in the snow.

It is also an object of my invention to provide a portable seating device for usage by alpine or cross-contry skiers.

It is a further object of my invention to provide a portable seating device which is concealed within an ordinary ski pole, thereby avoiding the necessity of the skier carrying additional pieces of equipment.

These and other objects of my invention will be readily apparent to one of ordinary skill in the art.

BRIEF DESCRIPTION OF THE DRAWINGS

FIG. 4 is a rear view of the ski pole handle utilized in conjunction with the invention.

FIG. 5 is a top view of the ski pole handle.

FIG. 6 is a cross-sectional side view of the top of the ski pole handle.

FIG. 7 is a top view of the break-away insert utilized in one embodiment of the invention.

FIG. 8 is a side view of the break-away insert shown in FIG. 7.

FIG. 9 is a top view of the break-away insert utilized in an alternate embodiment of the invention.

FIG. 10 is a side view of the break-away insert shown in FIG. 9.

FIG. 11 is a top view of a male end buckle showing the seating strap and wrist strap utilized in one embodiment of the invention.

FIG. 12 is a side view of the male end buckle and seating and wrist straps shown in FIG. 11.

DETAILED DESCRIPTION OF THE DRAWINGS

Figure 1:
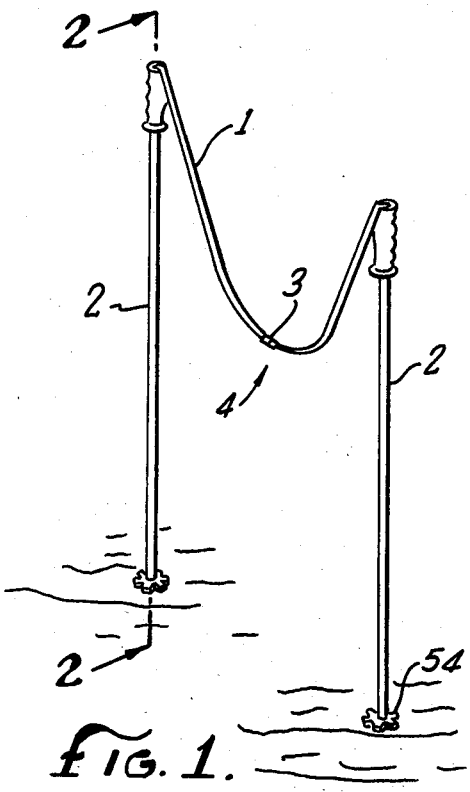
FIG. 1 is a perspective view of one embodiment of the invention as it appears in actual use.

The invention as utilized by the skier is shown in FIG. 1. A retractable seating strap 1 is located within each of the skier's ski poles 2. The exterior end of the retractable seating strap is equipped with a locking clasp 3. The skier interlocks the locking clasps 3 and pulls the ski poles apart thereby creating the seating sling 4 shown in FIG. 1. The skier then inserts the ends of the ski poles into the snow and sits down upon the seating sling 4.

Figure 2:
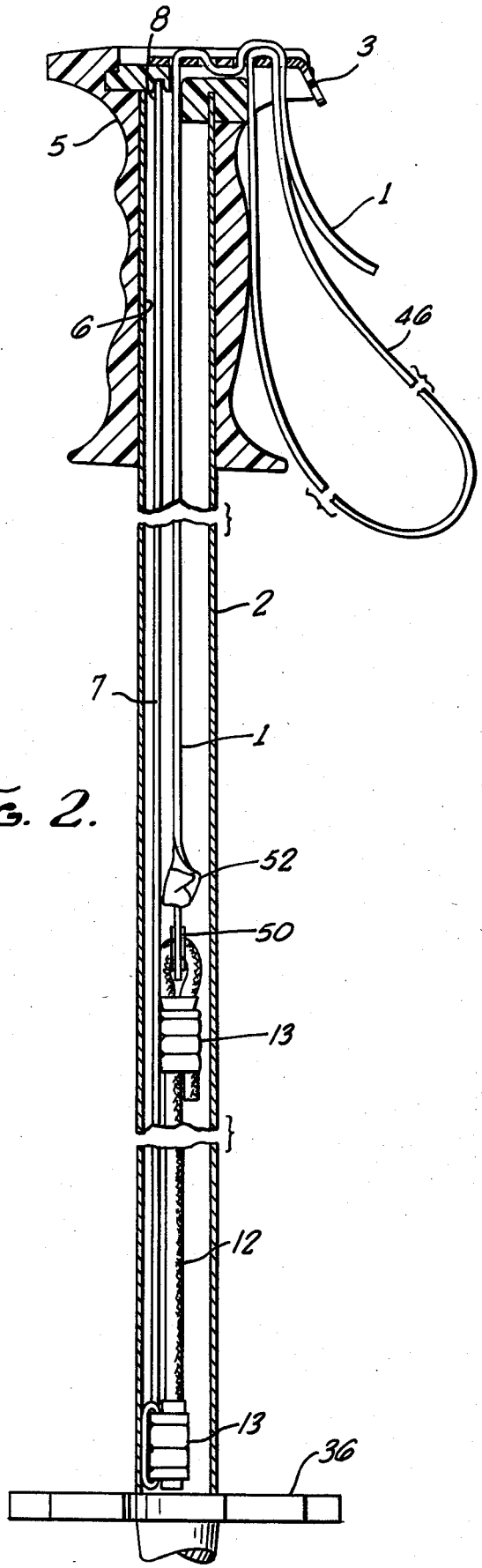
FIG. 2 is a cross-sectional view of the seating strap as it is situated within a ski pole.

The components of one embodiment of this invention are shown in FIG. 2. The invention is comprised of a pair of ski pole handles 5 with each handle having a hollow cylindrical center 6 with an inner diameter slightly less than the exterior diameter of the standard ski pole 2. A rectangular recess 20 is cut beneath the top surface of the handle 5 as shown in FIGS. 4 and 5, with the upper face of the top of the handle extending outward over the recess 20 forming a locking rim 22 as also shown in FIGS. 4 and 5. The locking rim 22 also extends outward over the rear face 23 of the handle as shown in FIG. 6. A rectangular notch 24 is cut from the back of the handle 5 as shown in FIG. 5. A second rectangular notch 25 is cut from the rear of the handle 5 thereby creating a step 27 between the notch 25 and the recess 20 as shown in FIG. 6.

In the preferred embodiment the handles 5 are constructed from any suitable material, such as plastic or rubber, which is softer than the ski poles 2 and will expand thereby allowing the slightly larger ski poles 2 to be inserted into the hollow cylindrical center 6.

Figure 3:
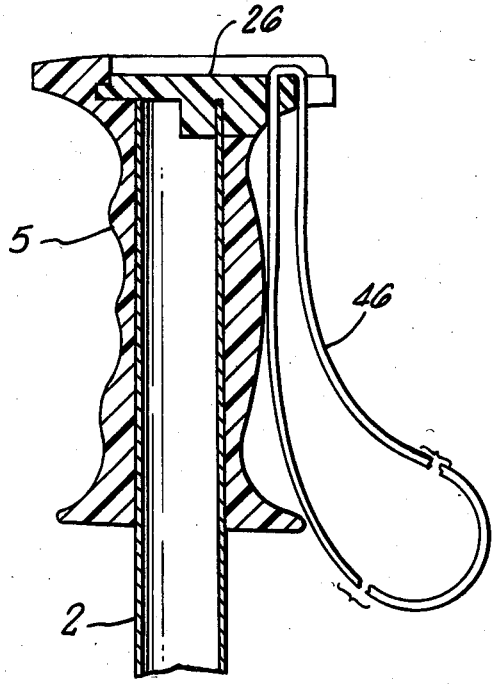
FIG. 3 is a cross-sectional side view of a ski pole handle utilized in conjunction with one embodiment of the invention.

A breakaway insert 26 is fitted within the recess 20. The placement of the insert 26 within the recess 20 is shown in FIGS. 2 and 3. One embodiment of the insert 26 is shown in FIGS. 7 and 8. As shown in FIG. 7, the insert 26 has a basic rectangular configuration and has a pair of elbows 28 extending outward from the rear sides of the insert. A locking pin 31 extends frontward from the front face 29 of each of the elbows 28. The upper section 32 of the insert is recessed back from the outer edges of the insert as shown in FIGS. 7 and 8, thereby creating a locking edge 34. The front half of the bottom of the insert 26 is notched as shown in FIG. 8. This creates a lower front edge 36. A semi-cylindrical section 38 extends downward from the bottom of the insert as shown in FIG. 8. As shown in FIG. 7, the semi-cylindrical section 38 is located with a semi-circular recess 40 located in the front of the lower front edge 36. A circular channel 42, having a width slightly greater than the wall thickness of a standard ski pole, runs between the semi-cylindrical section 38 and the recess 40. The insert 26 is inserted within the top of the handle 5 such that the locking edge 34 fits within the recess 20 and underneath the locking rim 22. The lower edge 36 abuts the step 27 and the front face 29 abuts the rear face 23 of the insert 26, the locking pins 31 fitting within locking pin holes 44 located in the rear face 23. FIG. 3 shows the insert 26 in place within the handle 5.

A curved notch 44 is cut in the rear of the insert 26 to receive the wrist-strap 46. A slot 48 is cut through the insert 26 as shown in FIG. 7. The wrist-strap is threaded through the slot 48 and over the notch 44 as shown in FIG. 3.

In an alternate embodiment, the break-away insert 26*a* is used in conjunction with a seating device. The break-away insert 26*a* used in this embodiment is shown in FIGS. 9 and 10. The insert 26*a* is similar to insert 26 with the following distinctions. On insert 26*a* the upper edge 35 of the locking edge 34 is beveled as shown in FIG. 9, to facilitate it's upward removal from the handle 5. Also the slot strap 49 is located in front of the semi-cylindrical section 38. The beveling of the upper edge is necessitated by the location of the slot 49 in the mid-point of the insert 26*a* as opposed to the location of slot 48 at the outer edge of insert 26. A tapered recess 8 is located in the bottom of the insert 26*a* in front of the slot 49.

In this embodiment a support wire 7 is mounted within the cylindrical center 6 of the ski pole handle 5. One end of the support wire 7 fits within a tapered recess 8 located in the bottom of the insert 26*a*. The tapered recess 8 is comprised of a conical section 10 which narrows to a cylindrical channel 11. The mouth of the conical section 10 is of a greater diameter than the wire support 7, while the diameter of the cylindrical channel 11 is slightly smaller than the diameter of the wire support. When the wire support 7 is inserted into the recess 8 the walls of the cylindrical channel 11 distend and allow for full insertion of the wire support 7. The cylindrical channel 11 being of a smaller diameter than the wire support 7 causes the walls of the channel 11 to hold the wire support 7 in place and prevent the wire 7 from becoming dislodged from the channel.

In the preferred embodiment the support wire 7 is approximately 36" in length which is less than the length of the standard ski pole. A retraction device 12 is attached to the lower end of the support wire 7. In the preferred embodiment, the retraction device 12 is an elastic cord constructed from any suitable material which upon being stretched or distended will return to its normal position or size. The retraction device 12 is attached to the support wire 7 by any suitable clamping device 13. In the preferred embodiment the clamping device 13 is a metal ring or collar which is crimped around both the retraction device 12 and the support wire 7. The retraction device 12 is approximately one-third the length of the support wire 7. The retractable seating strap 1 is then attached to the upper end of the retraction device 12 by a clamping device 13 similar to the device utilized to join the support wire 7 and the retraction device 12. In the preferred embodiment, the lower end of the strap 1 is knotted and the retraction device 12 passes through an eyelet 50 in the end of the strap. This configuration is shown in FIG. 2. The seating strap is approximately one-half inch in width.

The exterior end of the retractable seating strap 1 passes through the slot 49 in the break-away insert 26*a*. This exterior end of the strap 1 is threaded onto a locking clasp 3 as shown in FIGS. 11 and 12. When not in use as a seat, the locking clasp 3 rests on top of the insert 26*a* shown in FIG. 2.

In actual use, the skier pulls each locking clasp 3 out from the top of the insert 26*a* and interlocks the clasps 3. The clasps 3 may be of any suitable type having a male and female ends which will interlock with each other. This movement stretches the retraction device 12 and allows for the retractable strap 1 to be withdrawn from within the ski pole 2. The skier then stretches the ski poles 2 apart to a distance slightly greater than his or her body width and sits down on the strap 1. The strap 1 is then pulled outward from within the ski pole 2 stretching the retraction device 12 until the knot 52 makes contact with the bottom of slot 49. The knot 52 is of a greater diameter than the slot 49 thereby preventing further movement of the strap 1. The user then adjusts the straps 1 to the desired seating height.

A wrist-strap 46 is attached to the clasps 3 by threading it onto the clasp as shown in FIGS. 11 and 12. The wrist strap is formed into a loop by any suitable buckle means. The skier may then insert his hand through the loop and utilize the wrist strap loop to assist him while skiing. In the preferred embodiment the wrist-strap 46 is approximately one inch in width. The wider width prevents undue stress being placed on the skier's wrist and thumb.

The wrist-strap 46 may be formed from a strap which is sewn or otherwise connected to the narrower seating strap 1 or it may be a completely separate strap that is threaded onto the clasp 3 along with the strap 1. An embodiment in which the wrist-strap 46 is separate from the seating strap 1 is shown in FIG. 12.

In the past a problem has existed with wrist straps causing injuries to the skier's wrist or thumb if the ski pole basket 54 became lodged in the snow while the skier was in motion. Both embodiments of the present invention eliminate this problem by means of the break-away inserts 26, 26*a*. The inserts 26, 26*a* are set within the handle 5 and are of a harder material than the handles. Upon the ski pole basket 54 becoming lodged in the snow an upward force is exerted by the skier's wrist and thumb upon the wrist-straps 46 and in turn upon the inserts 26, 26*a*. When sufficient force is exerted upward the inserts 26, 26*a* are pulled upward free of the locking rim 22 thereby releasing the force on the skier's wrist before injury can occur. Further, in one embodiment the wrist-strap 46 will pull on the elastic retraction device 12 allowing the skier to extend a further distance from the pole 2 in an elastic manner to further minimize any strain on the skier.

The skier may then re-insert the insert 26 within the handle 5. The locking rim 22 is designed such that it will return to its normal position after being distended by the pulling out of the insert 26, 26*a*.

To assemble the invention, the retractable seating strap assembly and wrist strap assembly described above, comprised of the ski-pole handle 5 with insert 26 in place, the support wire 7, the retraction device 12 and the seating strap 1 is inserted onto a standard ski-pole 2. The ski pole 2 is inserted within the cylinder 6 of the handle 5, the inner walls of the cylinder 6 expanding about the pole 2 thereby exerting a constant force against the pole 2 restricting its removal from within the handle 5. The pole 2 is inserted within the handle such that the upper end of the pole 2 rests within the channel 42 located in the bottom of the insert 26*c*. This alignment is shown in FIG. 2. The walls of the ski-pole 2 prevent the support wire 7 from deflecting or bending to the side. With the ski-pole walls providing lateral support for the invention the support wire 7 need only be of sufficient strength to prevent the wire from collapsing upward upon itself when the weight of the skier is applied to the seating strap.

When not being utilized in the sitting position the seating strap is retracted back inside the ski-pole. This retraction is accomplished by the support wire 7 maintaining the lower end of the retraction device 12 in a fixed position at the bottom of the ski-pole 2 and the retraction device returning to its normal length of approximately one-third of the length of the ski-pole and accordingly pulling a section of the seating strap 1 approximately equal in length to two-thirds the length of the ski-pole 2 inside the ski-pole. In this position the clasp 3 is retracted and rests atop insert 26*a*.

In an alternate embodiment of the invention, the ski pole handle 5 may be constructed out of a moldable material such as ethylene vinyl acetate, a variety of which is currently available from duPont Chemical Company under the trademark "Elvax". This handle may be inserted into a pot of boiling water and then contoured to fit the skiers own personal grip merely by grasping the heated handle and squeezing the handle into the desired configuration.

Having thus described my invention, these and other embodiments will be readily available to those of ordinary skill in the art and the invention is not intended to be limited to the preceding description but is intended to be of the full breadth of the appended claims.

What is claimed is:

1. A portable ski-pole wrist strap assembly comprising a pair of hollow ski poles and ski pole handles wherein each of said ski pole handles has a hollow center section and a break-away insert wherein the break-away insert is fitted within a recess in the top of the handle, said recess having a locking rim which extends inward around the perimeter of the recess and extending over the outer edge of the break-away insert, said insert having a semi-cylindrical section extending downward which is aligned with the hollow center section and containing a slot through the body of the insert, said slot not being aligned with the hollow center section of the ski pole handle, said handle being inserted over the end of a ski pole such that said semi-cylindrical section fits within the hollow center of the ski pole which is inserted within the hollow center section of the ski pole handle.

2. A portable ski-pole wrist strap and seat assembly comprised of a plurality of ski poles wherein each of said ski poles contains a retractable seating strap assembly fitted within the body of said ski poles, wherein each seating strap assembly is comprised of:

a handle having a hollow center section and a break-away insert wherein the break-away insert is fitted within a recess in the top of the handle, said recess having a locking rim which extends inward around the perimeter of the recess, said insert having a semi-cylindrical section extending downward which is aligned with the hollow center section and containing a slot through the body of the insert, said slot connecting the outside exterior of the ski handle with the hollow center section of the handle, said handle being inserted over the end of a ski pole;

a support element one end of which is mounted within the hollow center section of said handle;

a retraction device attached to the opposite end of said support element;

a seating strap, one end of which is attached to the free end of the retraction device, the opposite end of the seating strap passing through the slot in the break-away insert;

a locking device attached to the exterior end of the seating strap; and a wrist strap which is attached to the locking device along with the seating strap.

3. A portable ski-pole seat as claimed in claim 2 wherein the retraction device is an elastic cord.

4. A portable ski-pole seat as claimed in claim 2 wherein the seating strap is attached to the retraction device by a clamp means which is fastened about the joined retraction device and seating strap, said clamp being of a greater diameter than the width of the aperture connecting the exterior surface of the handle and the hollow center section of the handle.

5. A portable ski-pole seat as claimed in claim 2 wherein the locking device rests on top of the break-away recess when the ski-pole seat is not in use.

6. A portable ski-pole seat as claimed in claim 2 wherein the handle is constructed out of ethylene vinyl acetate.

7. A portable ski-pole seat as claimed in claim 2 wherein a wrist-strap is threaded onto the locking device so as to form a loop.

8. A portable ski-pole seat comprising:

a plurality of ski poles wherein each of said ski poles contains a retractable seating strip assembly fitted within the body of said ski poles, wherein each retractable seating strap assembly contains a locking means for interlocking the assemblies; and further wherein the retractable seating strap assembly is comprised of:

a handle having a hollow center section which is inserted over the end of a ski pole;

a support element, one end of which is mounted within the hollow center section of said handle;

a retraction device attached to the opposite end of said support element;

a seating strap, one end of which is attached to the free end of the retraction device, the opposite end of the seating strap passing through an aperture in the top of the handle, said aperture connecting the outside exterior of the ski handle with the hollow center section of the handle; and a locking device attached to the exterior end of the seating strap.

9. A portable ski-pole seat as claimed in claim 8 wherein the retraction device is an elastic cord.

10. A portable ski-pole seat as claimed in claim 8 wherein the seating strap is attached to the retraction device by means of a clamp which is fastened about the joined retraction device and seating strap, said clamp being of a greater diameter than the width of the aperture connecting the exterior surface of the handle and the hollow center section of the handle.

11. A portable ski-pole seat as claimed in claim 8 wherein the locking device rests on top of the handle when the ski pole seat is not in use.

12. A portable ski-pole seat as claimed in claim 8 wherein the handle is constructed out of ethylene vinyl acetate.

* * * * *